US010117500B2

(12) United States Patent
Samain et al.

(10) Patent No.: US 10,117,500 B2
(45) Date of Patent: Nov. 6, 2018

(54) MAKEUP METHOD AND A DEVICE FOR IMPLEMENTING SUCH A METHOD

(75) Inventors: Henri Samain, Bievres (FR); Didier Gagnebien, Sceaux (FR)

(73) Assignee: L'OREAL, Paris (FR)

( * ) Notice: Subject to any disclaimer, the term of this patent is extended or adjusted under 35 U.S.C. 154(b) by 315 days.

(21) Appl. No.: 13/001,727

(22) PCT Filed: Jul. 10, 2009

(86) PCT No.: PCT/IB2009/053014
§ 371 (c)(1),
(2), (4) Date: Feb. 16, 2011

(87) PCT Pub. No.: WO2010/004529
PCT Pub. Date: Jan. 14, 2010

(65) Prior Publication Data

US 2011/0162673 A1 Jul. 7, 2011

Related U.S. Application Data

(60) Provisional application No. 61/083,422, filed on Jul. 24, 2008.

(30) Foreign Application Priority Data

Jul. 10, 2008 (FR) ..... 08 54710

(51) Int. Cl.
*A45D 19/00* (2006.01)
*A45D 44/00* (2006.01)

(52) U.S. Cl.
CPC ..... *A45D 44/005* (2013.01); *A45D 2044/007* (2013.01)

(58) Field of Classification Search
CPC ... A45D 7/06; A45D 2044/007; A45D 44/005
(Continued)

(56) References Cited

U.S. PATENT DOCUMENTS 4,276,570 A 6/1981 Burson et al.
5,478,238 A 12/1995 Gourtou et al.
(Continued)

FOREIGN PATENT DOCUMENTS

DE 101 53 249 A1 5/2003
EP 1 210 908 A2 6/2002
(Continued)

OTHER PUBLICATIONS

Apr. 15, 2014 Office Action issued in U.S. Appl. No. 13/001,671.
(Continued)

*Primary Examiner* — Cris L Rodriguez
*Assistant Examiner* — Brianne Kalach
(74) *Attorney, Agent, or Firm* — Oliff PLC

(57) ABSTRACT

The present invention provides a method of making up human keratinous material, the method comprising: taking at least two measurements of an optical characteristic of said keratinous material at different locations; and applying a composition to the keratinous material, the composition modifying a characteristic of the appearance of said keratinous material so as to give it an optical characteristic intermediate between the measured optical characteristics.

9 Claims, 2 Drawing Sheets

(58) Field of Classification Search
USPC ..... 132/200, 207, 333; 600/476, 310, 587, 600/317, 431; 356/425; 607/88–89; 424/70.1, 70.51; 604/289, 290; 702/100
See application file for complete search history.

(56) References Cited

U.S. PATENT DOCUMENTS

| | | | | |
|---|---|---|---|---|
| 5,836,872 | A | 11/1998 | Kenet et al. | |
| 5,931,166 | A | 8/1999 | Weber et al. | |
| 6,035,860 | A | 3/2000 | Mombourquette | |
| 6,128,516 | A | 10/2000 | Macfarlane et al. | |
| 6,543,893 | B2 | 4/2003 | Desormeaux | |
| 6,622,733 | B2 | 9/2003 | Saksa | |
| 7,290,550 | B2 | 11/2007 | Sim | |
| 7,349,857 | B2 | 3/2008 | Manzo | |
| 7,454,046 | B2 | 11/2008 | Chhibber et al. | |
| 7,648,364 | B2 | 1/2010 | Dauga et al. | |
| 7,738,032 | B2 | 6/2010 | Kollias et al. | |
| 7,856,118 | B2 | 12/2010 | Kalla et al. | |
| 7,890,152 | B2 | 2/2011 | Edgar et al. | |
| 8,007,062 | B2 | 8/2011 | Edgar et al. | |
| 8,027,505 | B2 | 9/2011 | Edgar et al. | |
| 8,094,186 | B2 | 1/2012 | Fukuoka et al. | |
| 8,094,879 | B2 | 1/2012 | Kalla et al. | |
| 8,155,413 | B2 | 4/2012 | Chhibber et al. | |
| 8,231,292 | B2 | 7/2012 | Rabe et al. | |
| 8,260,010 | B2 | 9/2012 | Chhibber et al. | |
| 8,373,859 | B2 | 2/2013 | Chhibber et al. | |
| 2001/0018061 | A1 | 8/2001 | Rhoades | |
| 2002/0155069 | A1* | 10/2002 | Pruche et al. | 424/47 |
| 2003/0108542 | A1 | 6/2003 | Pruche et al. | |
| 2004/0078278 | A1 | 4/2004 | Dauga et al. | |
| 2004/0164992 | A1* | 8/2004 | Gangnet | G06T 11/001 345/591 |
| 2005/0053628 | A1 | 3/2005 | Montanari et al. | |
| 2005/0148908 | A1 | 7/2005 | Skover et al. | |
| 2005/0159655 | A1 | 7/2005 | Kao | |
| 2005/0191252 | A1 | 9/2005 | Mitsui | |
| 2006/0098076 | A1 | 5/2006 | Liang | |
| 2006/0246020 | A1 | 11/2006 | Cole et al. | |
| 2006/0274071 | A1 | 12/2006 | Bazin | |
| 2007/0035815 | A1* | 2/2007 | Edgar et al. | 359/359 |
| 2007/0049832 | A1 | 3/2007 | Edgar et al. | |
| 2007/0114305 | A1 | 5/2007 | Yamaguchi et al. | |
| 2007/0258656 | A1 | 11/2007 | Aarabi | |
| 2008/0024583 | A1 | 1/2008 | Noe et al. | |
| 2008/0192999 | A1 | 8/2008 | Edgar et al. | |
| 2008/0193195 | A1 | 8/2008 | Edgar et al. | |
| 2008/0212894 | A1 | 9/2008 | Demirli et al. | |
| 2008/0219528 | A1 | 9/2008 | Edgar et al. | |
| 2009/0054744 | A1 | 2/2009 | Kitamura et al. | |
| 2009/0118600 | A1 | 5/2009 | Ortiz et al. | |
| 2009/0196496 | A1* | 8/2009 | Kalla | A45D 44/005 382/165 |
| 2009/0279760 | A1 | 11/2009 | Bergman | |
| 2009/0280150 | A1 | 11/2009 | Kamen et al. | |
| 2010/0185064 | A1 | 7/2010 | Bandic et al. | |
| 2010/0243514 | A1 | 9/2010 | Samain et al. | |
| 2010/0252061 | A1 | 10/2010 | Samain et al. | |
| 2010/0271470 | A1 | 10/2010 | Stephan et al. | |
| 2011/0124989 | A1 | 5/2011 | Edgar et al. | |
| 2011/0129283 | A1 | 6/2011 | Samain | |
| 2011/0159463 | A1 | 6/2011 | Samain | |
| 2011/0162673 | A1 | 7/2011 | Samain et al. | |
| 2012/0017929 | A1 | 1/2012 | Samain et al. | |
| 2012/0024308 | A1 | 2/2012 | Giron et al. | |
| 2012/0044335 | A1 | 2/2012 | Goto | |
| 2012/0067364 | A1 | 3/2012 | Wong | |
| 2012/0250222 | A1 | 10/2012 | Zhou et al. | |

FOREIGN PATENT DOCUMENTS

| | | | |
|---|---|---|---|
| EP | 1 298 587 | A2 | 4/2003 |
| EP | 1 310 212 | A1 | 5/2003 |
| EP | 1 459 782 | A2 | 9/2004 |
| FR | 2 603 183 | A1 | 3/1988 |
| FR | 2 810 761 | A1 | 12/2001 |
| FR | 2 861 883 | A1 | 5/2005 |
| GB | 2 343 657 | A | 5/2000 |
| JP | A-2004-521926 | | 7/2004 |
| JP | A-2005-245521 | | 9/2005 |
| JP | A-2006-297691 | | 11/2006 |
| WO | WO 02/00189 | A1 | 1/2002 |
| WO | WO 02/01499 | A2 | 1/2002 |
| WO | WO 03/033270 | A1 | 4/2003 |
| WO | WO 2004/090629 | A2 | 10/2004 |
| WO | WO 2007/022095 | A1 | 2/2007 |
| WO | WO 2007/056569 | A2 | 5/2007 |

OTHER PUBLICATIONS

Jun. 13, 2013 Office Action issued in U.S. Appl. No. 13/001,720.
Dec. 24, 2013 Office Action issued in U.S. Appl. No. 13/001,671.
http://www.utexas.edu/opa/blogs/culturalcompass/2010/01/27/hair-and-makeup-test-photos-from-gone-with-the-wind/.
Nov. 27, 2013 Office Action issued in U.S. Appl. No. 13/001,720.
Nov. 11, 2014 Japanese Office Action issued in Japanese Patent Application No. JP-A-2011-517306.
Oct. 2, 2015 Office Action issued in U.S. Appl. No. 13/001,689.
H. Katerinopoulos, *Current Medicinal Chemistry*, 2002, vol. 9, pp. 275-306.
International Search Report issued in PCT/IB2009/053011, dated Nov. 2, 2009.
International Search Report issued in PCT/IB2009/053012, dated Nov. 2, 2009.
International Search Report issued in PCT/IB2009/053015, dated Oct. 30, 2009.
International Search Report issued in PCT/IB2009/053014, dated Nov. 2, 2009.
International Search Report issued in PCT/IB2009/053013, dated Sep. 30, 2009.
Written Opinion issued in PCT/IB2009/053011, dated Nov. 2, 2009.
Written Opinion issued in PCT/IB2009/053012, dated Nov. 2, 2009.
Written Opinion issued in PCT/IB2009/053015, dated Oct. 30, 2009.
Written Opinion issued in PCT/IB2009/053014, dated Nov. 2, 2009.
Written Opinion issued in PCT/IB2009/053013, dated Sep. 30, 2009.
U.S. Appl. No. 13/001,720, filed Dec. 28, 2010 in the name of Henri Samain et al.
U.S. Appl. No. 13/001,671, filed Dec. 28, 2010 in the name of Henri Samain.
U.S. Appl. No. 13/001,689, filed Dec. 28, 2010 in the name of Henri Samain.
U.S. Appl. No. 13/001,688, filed Dec. 28, 2010 in the name of Henri Samain.

* cited by examiner

MAKEUP METHOD AND A DEVICE FOR IMPLEMENTING SUCH A METHOD

The present invention relates to making up human keratinous material, for example the skin.

BACKGROUND

Almost everybody presents non-uniformities of color on varying scales that relate to the face and also to the bust, the neck, the hands, and the body as a whole.

These non-uniformities are often mere differences in color, but they can also be associated with non-uniformities in three-dimensional shape, e.g. recesses, dilated pores, or small scars, because of the light and shade effects they create.

Although these color non-uniformities are well accepted by some people, many people are ill-at-ease with all or some of the non-uniformities presented by their skin. This is particularly true of non-uniformities that lie on skin that can be seen, for example the face, the hands, the bust, or the scalp.

From time immemorial, and all over the globe, compositions that present covering power have been used to mask such non-uniformities. By way of example, they may be in the form of a cream or a fluid for applying by hand and in general they contain pigments. They are applied either on the non-uniformity alone, or over a larger area, thereby extending beyond the non-uniformity itself.

Great progress has been made in improving such compositions, but it nevertheless remains that they present a drawback that it is difficult to overcome, namely since their color is predefined they do not take account of the color of the skin.

This can raise two problems.

The first is that it is necessary to make the color of the composition that is purchased match the color of the purchaser's own skin. The slightest difference often produces a visible effect. This drawback can be limited by masking the entire face with the composition. However, under such circumstances, the face or the body portion concerned is visibly made up, and therefore does not look natural.

The second problem is that the color of the skin of a single body varies considerably from one location to another. Some portions are more pigmented, others less, some are yellower, redder, or bluer in color. These differences are not necessarily large differences, but the human eye is sensitive to small color differences. To be effective, it is necessary to treat all portions of the body with compositions of different colors. This is theoretically possible, and sometimes even done. However such work is very time-consuming and requires technical competence that is not compatible with everyday application of makeup.

Publication WO 2007/022095 A1 discloses a method of applying makeup in which an agent that modifies the reflectance of the skin is applied to the skin by using ink jet printer technology. In one embodiment, the device includes a scanner and an ink jet printer, and in a single pass over the skin it analyses the skin, identifies unattractive characteristics, calculates the improvements to be made, and applies the agent that modifies reflectance so as to obtain those improvements. For example, the device can give a softer appearance to the skin by identifying pale and dark points and by applying the reflectance-modifying agent so as to darken pale points using a predefined averaging technique. The device may include means for recognizing the treated zone, e.g. the cheek bone or the cheek so that the improvements made are specific to the zone being treated, e.g. making cheeks look rosy so as to give the appearance of a person in better health, or darkening zones under the cheek bones so as to make them less prominent. A colorant may be deposited on certain portions of the skin to make it more uniform and markers that fluoresce under ultraviolet illumination may be used to make it easier to recognize certain regions during treatment. In an example seeking to simulate tanning, an agent that modifies the spectral characteristics of the skin is applied so as to reduce contrast between pale and dark zones, darkening zones of the skin in selective manner, while causing certain details of the skin to disappear. In another element, pale zones around wrinkles are darkened but the hollow zones within wrinkles are not modified.

Publication WO 2004/090629 A2 discloses a method of printing on the skin.

U.S. Pat. No. 6,543,893 describes an ink jet printer suitable for being moved manually over the skin. The printer may have a screen for displaying images that are to be printed and a device that enables the image to be personalized, e.g. by adding text or other information.

U.S. Pat. No. 6,622,733 describes an applicator having an ink jet printer head.

Application US 2006/0098076 discloses a system for ink jet printing on the skin that includes means for positioning the face. The printer system is suitable for printing hairs on the eyebrows or for printing color on the cheeks for blending in with a brush.

Application WO 02/01499 A2 describes a method of applying makeup by means of a movable applicator head supported by an arm that is articulated so as to follow the three-dimensional shape of the zone being made up. The three-dimensional shape is acquired with the help of one or more cameras. A design selected by the user can be printed using an ink jet. The printing may serve to cover a pigment mark with the same color as the surrounding skin, after performing colorimetric analysis thereon.

Application DE 10153249 A1 describes a method of applying compositions on the skin by means of an ink jet printing technique. Printing may be performed using a handpiece held by the user. In a variant, the print head may move relative to the skin by moving a belt or a carriage on a rail that is itself movable on two slideways at its ends.

Publication JP 2006-297691 discloses a printer system for printing an image on the skin, the system being fitted with means that enable the color of the skin to be measured. The printer system takes account of the color of the skin in the image that is to be reproduced, the print head being provided with a photodetector. For example, for a dark skin, the quantity of ink is increased. In a variant, not only is the lightness of the skin taken into consideration but also its color when calculating the image for printing.

Publication GB 2 343 657 describes a portable ink jet printer suitable for printing a mark authorizing entry to a concert or a discotheque on the forearm or the hand of a person. The ink that is deposited may be visible, fluorescent, magnetic, phosphorescent, or photochromic.

Application WO 02/00189 A1 describes a method of applying a colored composition on the skin in which it is possible to select a blemish on an image of the zone for treatment, which image is obtained by means of a camera that also measures color. Image modification software makes it possible to correct a blemish in the zone for treatment, e.g. a depigmented zone, by outlining the zone with the help of a computer mouse and then printing on the corrected zone the color of the surrounding zone.

Publication WO 03/033270 discloses an ink jet printer that can be positioned manually on the skin in order to print a tattoo.

Publication US 2007/0114305 describes an electrostatic spray device for making up the skin.

U.S. Pat. No. 7,290,550 discloses an installation capable of printing on the skin, in particular on the skin of the face.

Numerous appliances are also known for printing on the nails, e.g. from U.S. Pat. Nos. 5,931,166 and 6,035,860.

None of those known printer devices is entirely satisfactory, in particular for the purpose of obtaining makeup that is accurate, natural, and varied.

There exists a need to benefit from novel means for making up keratinous material, and for example hiding color or gloss non-uniformities in a manner that is difficult to see.

SUMMARY

Examplary embodiments of the invention seek specifically to satisfy this need and provide a method of making up human keratinous material, for example the skin or the hair, the method comprising:

taking at least two measurements of an optical characteristic, in particular color or gloss, of said keratinous material at different locations; and applying a composition to the keratinous material, the composition serving to modify a characteristic of the appearance of said keratinous material so as to give it an optical characteristic intermediate between the measured optical characteristics, in particular a color or a gloss intermediate between the measured colors or glosses.

The optical characteristic may be selected from luminance and color or a color component, e.g. L, $\bar{a}$, or $\bar{b}$ in the Lab CIE 1976 colorimetric system.

When the measurements at said locations are the same, e.g. when the measured colors are the same, the intermediate optical characteristic may be identical to the measured characteristic. For example, the deposit that is formed may have the same color.

The composition that is applied may comprise or one or more cosmetic inks. The composition may also serve to modify skin color or hair color by means of a chemical reaction, in particular when the composition is selected from self-tanning agents or whitening agents or other cosmetic compositions.

The above-mentioned reaction may be superficial.

For example, the method may include the step consisting in automatically applying a self-tanning agent and/or one or more cosmetic inks so as to blur the line of demarcation between a naturally-tanned zone and a zone that has been protected from the sun, e.g. by wearing a garment. The method may be implemented to mask the tan lines left by a bikini top or sunglasses, for example.

The method may be implemented on bare skin or on skin that has already been made up.

The deposit that is formed may be of a color that is solid or otherwise. When the deposit does not present a solid color, it should be understood that the deposit includes at least one zone having said intermediate color. The deposit may shade off between two locations where the measured colors are different.

At least two, and better three, measurements of the color of the keratinous material may be performed at different locations, and a deposit may be formed of a cosmetic of a color that is intermediate between the measured colors.

The deposit may be situated between locations where the measurements were taken. This deposit may cover a skin blemish, for example a spot, a scar, or a wrinkle, or a tan line, as mentioned above. The deposit may be performed at equal distances from the locations where the measurements were taken.

The measurements of color or of some other optical characteristic may be performed simultaneously or in a short lapse of time, for example with less than 5 minutes (min) between them.

The deposit may be formed within a short lapse of time after measuring color or some other optical characteristic, for example within less than 1 hour (h).

The invention makes it possible to take account of the fact that the color of the skin of any one person varies locally. The invention thus enables skin blemishes to be camouflaged better by making it possible for the presence of the zone that has been made up or treated with a self-tanning agent or a whitening agent to be made less visible.

In an implementation of the invention, at least three measurements are made of skin color at different locations, and cosmetic of a color intermediate between the three measured colors is deposited.

The intermediate color may be an average color, in particular a color obtained by taking the arithmetic mean of each of the three color components. The cosmetic deposit may also have a color that varies, but that passes through at least one color that is intermediate between the measured colors, better that is of a color that always lies between the measured colors, i.e. having color components that lie between the extremes of the measured values.

Color measurement and application of the deposit may be performed by using a single handpiece, thereby making the method easier to implement. In a variant, the color measurements may be performed using a single color-measurement appliance without any printer system, which appliance is moved successively to different locations, or by means of a plurality of color measurement probes that are placed at said locations. The color measurement probes may be separate from the printer system. The color measurement probes may be fastened to the skin by using a gel, an adhesive, or a suction cup, and they may be connected to the remainder of the device by cables or by a wireless system. The color measurements may be performed with the skin or the hair in contact with the apparatus used for making the measurement. Contact makes it possible to be independent of external lighting. Measurement resolution may be better than 1 centimeter (cm), in at least one direction.

Color or other optical characteristics may be measured at respective locations that are spaced apart by distances lying in the range 0.5 cm to 5 cm or even more.

The deposit made may be of a color, or a gloss, that varies close to the edges of the deposit so as to come close to the color, or the gloss, of the nearby skin. By way of example, the deposit may have a color that varies between the locations where color was measured, the color of the deposit approaching the respective colors measured at each of said locations in the vicinities thereof. This enables the deposit to blend in better with the neighboring regions of skin or hair.

The color of the deposit may result from using at least two inks of different colors, preferably at least three inks of different colors, that may be mixed and/or juxtaposed on printing.

Other exemplary embodiments of the invention also provide a device for applying makeup, the device comprising:

an acquisition system enabling at least two measurements of an optical characteristic of keratinous material to be performed at different locations, in particular measurements of its color;

a processor unit for calculating an optical characteristic that is intermediate between the measured optical characteristics, in particular an intermediate color; and a printer system (that can be any kind of deposition system) for depositing a cosmetic that imparts said intermediate optical characteristic by acting optically on the keratinous material, e.g. by applying one or more cosmetic inks, or a system for applying a composition that causes the keratinous material to be subjected to a chemical reaction and to a change of appearance so as to take on the intermediate optical characteristic, e.g. a self-tanning agent or a whitening agent.

The device may be used for making up: pigment spots; age spots; blackheads; acne; scars; stretchmarks; beauty spots; apparent veins; wrinkles; red spots; non-uniform tanning; vitiligo; erythrosis; rosacea; and non-uniformities of makeup (self-tanning agent). This list is not exhaustive.

It is also possible for men to make use of the device, e.g. for treating irregularities of skin tone, or of hair distribution.

The deposit that is formed may be of a color that is solid or otherwise.

The acquisition system may include at least two color sensors, and preferably at least three sensors. This enables simultaneous measurements to be performed and/or measurements to be performed with the device having accurate knowledge about the distances between the sensors.

The device may include a handpiece including the acquisition system and the printer system.

The printer system may be an ink jet or minispray system, or it may be of some other kind.

The printer system may include a source of vibration to create a fuzzy effect on application. When printing, the user may also move the printer system, e.g. by moving the handpiece a little.

The printer device may include an interface enabling the user to act, prior to printing, to modify the color of the deposit and/or the distribution of color within the deposit.

The acquisition system may include one or more photodetectors and lighting means of different colors. This may limit the use of expensive components. For example, the acquisition system may have a single photodetector placed in a measurement zone and associated with at least three LEDs placed in such a manner as to illuminate the measurement zone, with the LEDs being placed for example around the observation direction of the photodetector, e.g. distributed at equal angles. It is also possible to use a LED that is capable of emitting as a plurality of different colors.

The acquisition system may serve to perform at least two color measurements at different locations without moving the acquisition system relative to the skin. The acquisition system may also measure color at a first location and track movements over the keratinous material to a second measurement location, e.g. by including a movement sensor, e.g. a ball or a wheel making contact with the keratinous material, or an optical movement sensor.

Given that the device may be connected to other apparatuses or networks, the device may be caused to operate in a master mode (it causes other apparatuses to capture colors, make calculations, perform printing, and provide displays), or in a slave mode (another apparatus causes it to perform one or more actions selected from: capturing colors, making calculations, performing printing, providing displays). The device may be used not only on the skin, but also on other portions of the body, e.g. the hair or the nails or even for treating surfaces such as fabrics, wood, plastics materials, . . . .

Other exemplary embodiments of the invention also provide a device for applying makeup, the device comprising a print head, e.g. an ink jet print head, and a source of vibration to cause the print head to vibrate during printing. The frequency vibration may lie for example in the range 5 hertz (Hz) to 40,000 Hz. This may enable a deposit to be made without any sharp outline, and thus for it to be less visible.

Independently or in combination with the above, other exemplary embodiments of the invention also provide a device for applying makeup that includes a print head and an adjustment member enabling the user to vary the distance between the print head and the surface to be made up. This may serve to perform printing that is intense to a greater or lesser extent.

The invention can be better understood on reading the following detailed description of non-limiting implementations thereof, and on examining the accompanying drawings, in which.

Figure 1:
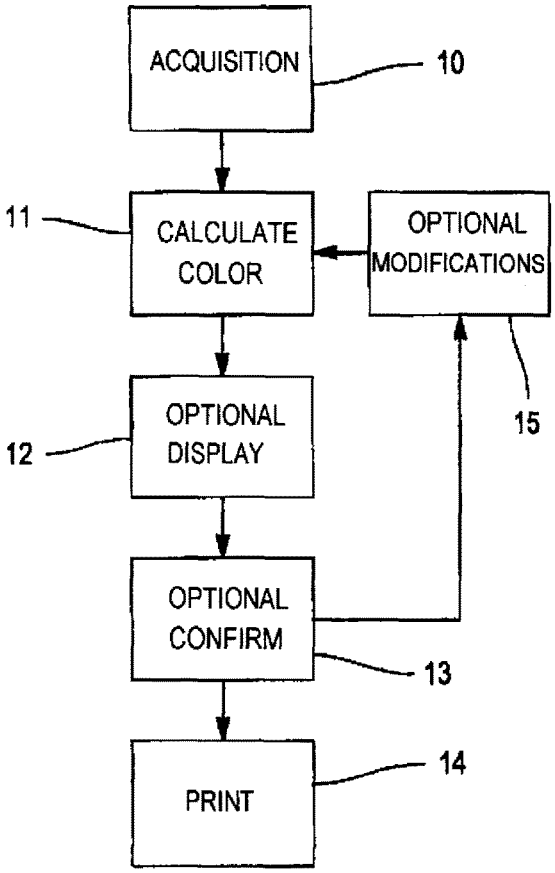
FIG. 1 is a block diagram showing various steps in an example method of the invention.
Figure 2:
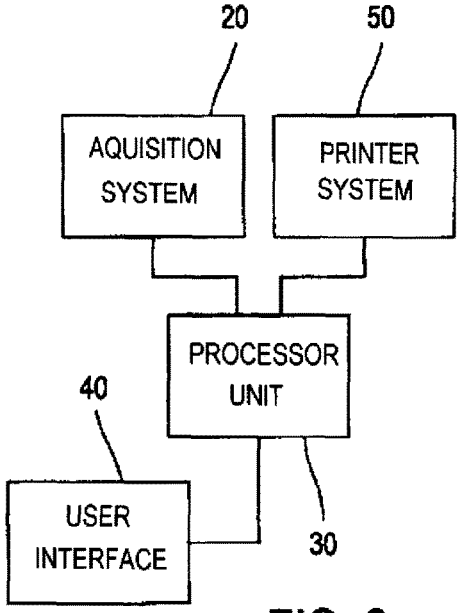
FIG. 2 is a block diagram showing different entities in a device made in accordance with the invention.

As shown in FIG. 1, the method of the invention may comprise a step 10 of capturing color at at least two locations on keratinous material. This capture is performed by means of an acquisition system 20 shown diagrammatically in FIG. 2 and described in greater detail below.

Acquisition step 10 is followed in the example described by a step 11 of calculating a color that is intermediate between the measured colors. This calculation is performed by a processor unit 30 that is likewise shown diagrammatically in FIG. 2.

Step 11 may be followed by a step 12 of displaying the image or the color that results from the calculation. This display may take place on a screen of a user interface 40.

After the image has been displayed, an optional step 13 of the user validating the displayed result may be necessary prior to performing print step 14. If validation is not given in step 13, then it is possible for the user to make a request in step 15 to modify the result of the calculation, and then step 15 may be followed by a new calculation.

The printing is performed with the help of a printer system 50 that is described in detail below.

Figure 3:
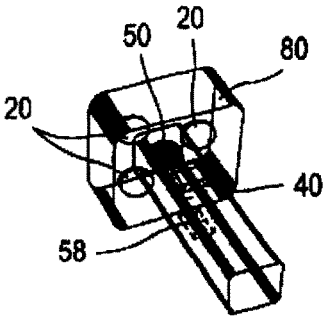
FIGS. 3 to 5 are diagrammatic and fragmentary perspective views showing various examples of devices of the invention.
Figure 4:
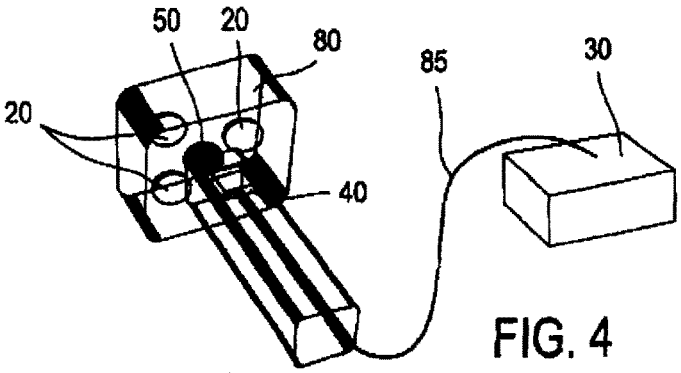

The acquisition and printer systems 20 and 50 may be grouped together within a single handpiece 80 that is shown diagrammatically in FIG. 3. The handpiece 80 may house the processor unit 30. In a variant, and as shown in FIG. 4, the handpiece 80 may be connected to the processor unit 30 over a wire or wireless connection 85.

Figure 5:
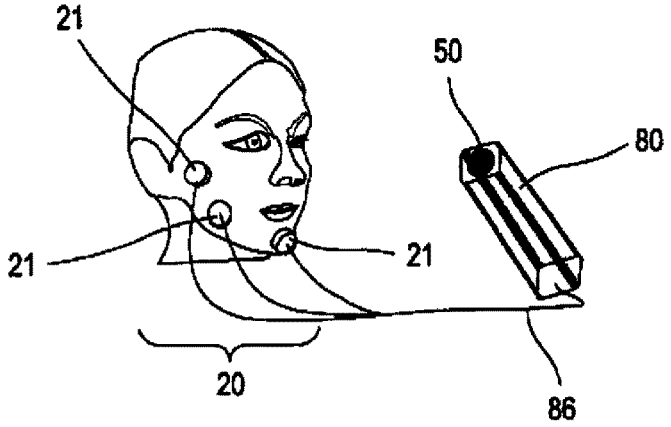

As shown in FIG. 5, the acquisition system 20 may also include one or more color-measurement probes 21 that are connected via a wire or wireless connection 85 to a handpiece 80 that houses the printer system 50. The handpiece 80 may house the processor unit or it may be distributed amongst the probes 21 and the handpiece. In another variant, the handpiece 80 and/or the probe(s) 21 may communicate with a remote processor unit. The probes 21 may be placed on the skin for the purpose of measuring color.

Printing may be performed between at least two locations where color has been measured. Where appropriate, a color measurement may also be performed at a printing location and possibly also beside it. A color measurement at the location where printing takes place may be useful, e.g. for the purpose of verifying that the color that results from deposition does indeed correspond to the expected color.

The processor unit 30 may comprise a microcomputer, a minicomputer, or any other electronic system, e.g. a programmable logic array.

The processor unit is provided with a memory or makes use of a memory. Any storage system is possible, for example a universal serial bus (USB) key, a memory internal to the computer, an electrically-programmable read-only memory (EPROM), memory cards, a hard disk, or indeed optical storage.

The presence of a memory may enable the result of a calculation to be printed several times over. Under such circumstances, the device may be moved and activated for printing purposes without capturing color again. A "reprint" button may be placed on the device, e.g. on the handpiece, in order to make this operation easier.

The memory may be conserved after the device has been switched off.

Provision may be made for the device to propose retaining in memory certain colors for printing, with this being done either by access via a menu or by having specific buttons to press. Each memory may be associated with a computer label, thereby enabling the user to associate a particular color with certain portions of the body, for example.

The portion of the handpiece that is placed on the skin, also referred to as the "contact" portion, may be plane or curved, e.g. curved to match the shape of a portion of the face, or of the body, e.g. a leg, an arm, a hand, the bust, the skull, . . . .

Contact surfaces are assessed in particular in the form of portions of a cylinder or of a sphere. The shape of the contact surface may in particular be adapted to the three-dimensional (3D) shape of the non-plane outlines of the face or the body. Where appropriate, the shape of the contact portion may be made to measure, after acquiring the three-dimensional shape of the user in the region to be treated.

The contact portion may be made out of flexible material so as to be deformable and thus fit more closely to the shape of the region of the body or the face on which it is placed.

The printer and/or acquisition systems may be adapted to the non-plane shape of the treated region. For example, the print head(s) may optionally be provided to track the non-plane shape of the skin, and they may be provided with an option for moving, specifically in a direction that is perpendicular to the skin. Thus, the apparatus may include at least one print head configured to be moved under motor drive and electronic control in a direction that is perpendicular to the skin or other surface so as to track the outline of said skin or surface. A distance detector and/or a contact detector may be used to ensure that the distance between the printer system and the skin is kept constant.

The device may contain safety systems such as a grounding contact, a differential trip switch, a system for tripping in the event of a hatch being opened on the base station (if any) or on the handpiece.

The device may be provided with a warning system to indicate that the sensors are properly positioned on the skin, in particular a system that detects the absence of any gap, and that provides information concerning proper positioning of the printer system on the skin. Thus, when the handpiece is not in contact with the skin, printing can be stopped.

The device may also calibrate colors and printing so as to optimize accuracy. Calibration may be an automatic function. Under such circumstances, the apparatus prints certain marks on a defined medium, either regularly or on each occasion an ink cartridge is changed. The apparatus may use a color sensor for determining the color of such printing and then calculate calibration functions by comparing the expected result with the result that is obtained. Calibration may be refined manually, where appropriate.

A warning system may provide a warning in the event of a component malfunctioning or an ink being used up.

The device may include a system for purging a print head after use or for cleaning the color sensor(s), e.g. a pneumatic system.

The device may be provided with a placing detection function. This function enables the handpiece to detect that it has been placed on the skin. It is possible to implement this function in various ways. For example, the handpiece may be provided with contact detectors, e.g. based on thermal or electrical conductivity, on one or more photoreceivers, on a pushbutton, with there being four detectors, for example. When all of the detectors detect contact, then the device considers that the handpiece has been put into place.

The device may also act as an acquisition system for determining whether it is in place on the skin. Thus, before lighting is switched on, if the color detectors detect no light, then the device considers that the handpiece is in place.

The device may include a visual or sound indicator to inform the user, e.g. that capture or printing has been performed.

The device may be provided with an interface enabling information to be sent or received, whether from a device of the same type or from other apparatuses, via an appropriate network, the Internet, or the telephone network.

The handpiece may optionally include an internal source of electricity, in the form of optionally rechargeable batteries.

Once the color value has been determined, printing may take place at different rates and also at different levels of intensity. For example, if it is desired to print a zone having an area of about 1 $cm^2$, then the volume of ink will typically be about 10 microliters (μL).

This volume may be sent to the print head at a maximum speed in order to finish off printing as quickly as possible. However it may be preferred to avoid the print head working at maximum speed, so as to enable the user to act during printing, e.g. to make a movement or to decide to remove the apparatus before printing has finished.

The volume may be small so as to obtain a transparency-type effect, or conversely it may be large so as to obtain more thorough coverage.

Acquisition System

The acquisition system includes at least one sensor for measuring color, and that is designed to measure the color of the skin, but, where appropriate, it may also be suitable for application to other surfaces, e.g. to fabrics, the hair, or photographs.

Any standard for physical representation of color may be used: red, green, blue (RGB); hue, value, chroma (HVC); Lab; cyan, magenta, yellow, black (CMYK); reflectance curves; . . . . The choice of standard may be pre-established in the device or left to the choice of the user.

The spacing between the various sensors may be fixed or adjustable, e.g. lying in the range 1 millimeter (mm) to 10 cm.

The skin may be illuminated with white light and the reflected light may be captured by three selective detectors responsive to red, green, and blue. In this particular setup, the acquisition system has one or more detectors responsive to all wavelengths and associated with specific filters.

It is possible to use a non-selective photodetector and to illuminate using light in three colors. Under such circumstances, use is made for example of red, green, and blue LEDs that illuminate the skin sequentially and that enable the intensity of the light reflected by the skin to be captured in the three colors. The light source(s) associated with a sensor may be spaced apart therefrom by a distance that is greater than or equal to 2 mm or 3 mm, for example.

Figure 6:
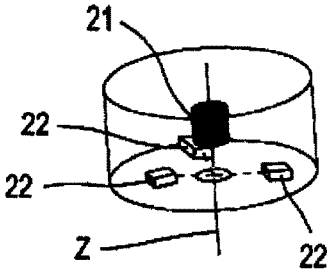
FIG. 6 shows an example of a color-measurement sensor.

FIG. 6 shows an arrangement comprising a photodetector 21 observing the skin along an axis Z, together with three light sources 22, e.g. LEDs, disposed around the axis Z, e.g. at equal angular spacing, so as to illuminate the skin in the zone observed by the photodetector 21.

The acquisition system advantageously includes one or more walls constituting shields to prevent ambient light reaching the sensor(s).

The device preferably includes at least two sensors, and better at least three. In a particular embodiment, use is made of a linear or matrix sensor, e.g. based on a charge-coupled device (CCD), or a complementary metal oxide on silicon (CMOS) device, or an electron-multiplying CCD (EM-CCD). Under such circumstances, the number of sensors (pixels) may reach tens or even hundreds of thousands, or even millions.

At least some, and possibly all of the sensors may be suitable for being inactivated, where appropriate, e.g. at the request of the user.

In a particular embodiment the extent of the capture zone may be modified without it being necessary to move the sensors over the skin, e.g. by means of an optical system, such as a set of lenses, for example. By way of example, an optical system made up of one or more movable mirrors may serve to extend the field of view of the skin, without moving the sensor(s).

Printer System

Any deposition technology can be used for the printer system.

Mention can be made in particular of offset printing, photogravure, flexography, silk-screen printing, pad printing, electrophotography (also known as xerography, electrostatic printing, or laser printing), thermal printing (including in particular simple thermal printing, thermal transfer printing, or thermal sublimation printing), elcography, toner jet, magnetography, ionography (also known as ion jet, electron beam imaging, or electrography), and ink jet printing (including in particular so-called "continuous ink jet" and "drop on demand" technologies).

Ink can be ejected as a jet or as droplets by a piezoelectric element, by a thermal element (bubble jet), by hot-melting, or by means of a valve (valve jet).

Mention may also be made of impact printing techniques, such as for example hammer or chain printing, needle or dot matrix printing, daisy wheel printing, thimble printing, and techniques such as minispray, gas printing, compressed air printing, liquefied gas printing, fluidized pressure printing, such as for example airbrushes or minisprays obtained by a moving part, e.g. a moving piezoelectric crystal.

The invention is better performed with contactless printing techniques, and in particular ink jet printing technologies and minispray techniques.

It is also possible to use printer means comprising a movable print element such as a sponge, a felt, a paint brush, a hollow tube, or a syringe, that contains ink that is put into contact with the skin for printing purposes. Contact time may be adjustable and may vary for example over the range 1/1000th of a second (s) to several seconds.

The term "printing" is used to mean delivering a composition onto the surface of the material for treatment, and in particular the skin. In the meaning of the invention, printing relates to delivering the composition onto or beneath the surface for treatment. Thus, printer means using needle printing technology can enable the ink to penetrate into the stratum corneum, the epidermis, or the dermis. For this purpose, it is possible to use strong needles or brittle needles, or the like.

The printer means may have a single print nozzle or a plurality of nozzles in parallel. The printer system may have nozzles that are dedicated to respective inks, or in a variant it may have a single nozzle for ejecting a plurality of different inks in succession or mixed together while printing is taking place so as to create the color that is to be printed.

The printer means may be spaced apart from the skin so as to avoid coming directly into contact with the skin. This spacing may be fixed or adjustable. It is possible to adjust the spacing either directly, e.g. by turning a knob or by acting on an adjustment button that controls the movement of a motor, or else automatically. For automatic adjustment, the processor unit controls a motor to change the spacing.

If it is desired to perform sharp printing, the spacing can be adjusted to a small value, e.g. one millimeter or less, and conversely, if it is desired to perform fuzzier printing it is possible to adjust the spacing to a greater distance, e.g. 1 cm or more.

The printer means may include a print head capable of printing over the entire surface for treatment. By way of example, the print head may include one or more ink ejection nozzles. Assuming that the user moves the device along an axis X, the print head may point perpendicularly to the travel direction X of the apparatus, for example.

The print head may be stationary within the device or it may be movable along an axis Y that is perpendicular to the axis X. For example, the device may perform Y-direction scanning of the print head, with or without printing, while the carriage is returning. The carriage may be driven by stepper motors, e.g. motors that are addressed directly via a USB port.

When the handpiece has a plurality of print heads that are not movable within the handpiece, the print heads may optionally be in alignment, e.g. they may be disposed in a staggered configuration.

The handpiece may include printer means that comprise at least one print head capable of moving relative to the above-mentioned carriage, along an axis Z that is perpendicular to the axes X and Y.

The print head may be actuated mechanically during printing, e.g. by a vibrator, so as to obtain a fuzzy effect. By way of example, FIG. 3 is a diagram of a vibrator 58 incorporated in the handpiece 80. Vibration may be directed parallel to the region for treatment.

The handpiece may include a vacuum or blower system for accelerating drying and/or a heater system.

When the ink deposited on the keratinous material requires exposure to light radiation, e.g. to ultraviolet (UV) light, in order to be polymerized, then the handpiece may include a corresponding lighting for assisting the polymerization of the ink(s) concerned.

The printer means may comprise a print line made up of a plurality of print elements disposed along a print line. The print elements may for example be nozzles that enable the color that is to be printed locally to be obtained on printing.

Printing may be performed by depositing a plurality of inks of different colors in juxtaposed manner or in at least partial superposition. The dots of different inks that are deposited may optionally be of the same size.

The surface of the skin may be covered completely by the ink(s) or gaps may be left between deposits of ink. Inks may be applied to the skin like a silk screen.

The image printed on the skin need not be uniform, i.e. printing may involve at least one ink being deposited in non-uniform manner over the surface for treatment.

The application may also be performed by applying a composition having a selected color contained in a reservoir of the device. The color of this composition may result from the mixing of two or more components.

The application system may apply a composition obtained by mixing of components of different colors outside the device.

For example, the handpiece may send data to a mixing unit. The mixing unit may mix two or more components to obtain a mixture having the desired color. In some embodiments, the user may use an independent mixing unit, that is configured to mix at least two components to produce a mixture having the desired color. The mixing unit may be used at, e.g., home, a point of sale, or at any suitable location.

In other embodiments, the handpiece may send data relating to the measured color to a decision unit. The decision unit may be located remotely and may be configured to identify, e.g., from a library of products, a product having the desired color.

In other embodiments, the user uses a decision unit. The decision unit is capable to identify, e.g., in a library, a product having the desired color. The mixing unit may be used, e.g., at home, at a point of sale, or at any suitable location.

The device may include a monitor system enabling the user or the device to determine whether printing is satisfactory or whether printing needs to be continued or corrected. By way of example, the monitor system uses the acquisition system or includes a camera or a color detector that is specific thereto. For example, the device may forward to a screen an image of the skin that is being treated. Although hidden by the device, the skin appears to be visible to the user, thereby enabling the user to assess the result while printing is taking place.

Printing may be performed while the handpiece is stationary relative to the skin.

When printing is performed with the handpiece moving over the skin, since the movement of the handpiece is not necessarily rectilinear, provision may be made for processing to be performed on a point-to-point basis rather than on a line-to-line basis, so that printing takes place in the identified position relative to the skin even if the path followed by the handpiece is curved.

Inks

The device may print a deposit that is made up of one or more cosmetic inks.

The inks are adapted firstly to the printing technology and secondly to the color that is desired.

The inks used are preferably fluid and may be based on water or organic solvents and may include at least coloring agents selected from natural or artificial dyes, possibly fluorescent or phosphorescent, organic and/or inorganic pigments, and mixtures thereof.

The ink may include one or more non-colored materials that provide optical effects, e.g. a fuzzy effect.

Where appropriate, one of the printed compositions may be a base coat or a top coat in order to improve retention of the inks, for example.

The coloring agent(s) and the optically active colorless agent(s) may be in a dispersion, dissolved, or in an emulsion. They may also form a mixture that is not very stable, that needs to be remixed or redispersed at the time of use.

By way of example, the inks may be contained in a cartridge or a group of cartridges that is easy to remove and replace.

One or more color ink cartridges may be used, e.g. corresponding to primary colors (cyan, magenta, yellow, and black) or to colors that are close to skin color (pink, ochre, beige, ivory, brown, . . . ).

In an implementation of the invention, a single printer nozzle is used with a plurality of ink cartridges of predefined colors. For example it is possible to use 1 to 1,000 e.g. sixteen colored inks, representing a set of colors that are usually to be found on the skin: pale beige, yellowish beige, pinkish beige, . . . . All of the cartridges are connected to the printer nozzle, and the device modulates the rate at which each of the cartridges delivers ink to the printer nozzle as a function of the color to be printed, e.g. using electrostatic microfluidic technology.

Processor Unit

The processor unit 30 may comprise a microcomputer, a minicomputer, a microcontroller, or any other electronic system, e.g. a programmable logic array.

The calculation performed on the basis of the measured values may be calculating an average value.

The weights of each of the captured colors in the calculation of the average may be equivalent, or they may differ, for example it is possible to privilege color capture of one color more than another, e.g. because one of the captured colors appears to be more attractive or closer to that which is expected of the skin. The processor unit may also seek to give precedence to one of the captured colors. The user may place the sensors at a location where it is preferable to give precedence to one of the color sensors, e.g. close to margins such as the edges of the face.

Other averaging calculations may be performed.

By way of example, if three sensors provide three red values R1, R2, R3, then the average for the red component is (R1+R2+R3)/3.

As explained above, it is also possible to consider that the weights of the various sensors differ, so that the component of the intermediate color is given for example by $R_{intermediate}=(aR1+bR2+cR3)/(a+b+c)$. $\bar{a}$, $\bar{b}$, and $\bar{c}$ may be functions or constants, for example functions that depend on lightness.

It may also be considered that the result is obtained in random manner and lies within a range determined by extreme values, thus making it possible to obtain results that are more natural. Thus, from one printout to another, the printer unit may introduce a random contribution in its calculations. Another approach consists in generating color components in random manner. Nevertheless, it is preferred for the calculations to ensure that the final result lies within the ambit determined by the capture values.

Processing may be made more complex in order to improve the result.

Thus, it is possible to take the average of the color components and apply mathematical processing thereto, such as for example shifting one or more color components or eliminating or correcting results that lie outside tolerance zones. For this purpose, the processor unit may be provided with data concerning tolerance zones. When the processing results lie outside a tolerance zone, the processor unit may either warn the user about this situation without preventing printing, or else it may prevent printing.

It is also possible to apply mathematical processing to the captured colors, e.g. prior processing consisting in eliminating or correcting values that are considered outliers, and then calculate the average after such prior processing.

One or more conversion tables may be used for calibration purposes, since some color values may be modified in order to improve the accuracy of rendering. Calibration conversion tables form the link between theoretical colors and colors as measured.

The conversion tables may also serve to create color transformation effects and they may be appropriate when the modification function is not simple and is not uniform depending on the colors under consideration.

The conversion tables may not only be addressable, they may also be modifiable, loadable or downloadable, and based for example in the memory of the processor unit.

Calculations may be performed amongst a plurality of averages so as to limit risks, e.g. the risk of one printout being clearly different from the preceding printout. Such smoothing may be based on calculations in which earlier averages are involved in addition to current color captures. Thus, on each new calculation, the processor unit may average the calculation with the average of a plurality of earlier calculations, e.g. the eight most recent calculations. The weights given to the earlier averages compared with the current color captures may be varied.

The apparatus may put printing on hold until the captured colors have stabilized. Color capture may be repeated so long as the values vary. It is only once the values have stabilized that printing is launched. If a sensor value does not stabilize, then the color value corresponding to the sensor may be ignored.

Proposed Example

Figure 7:
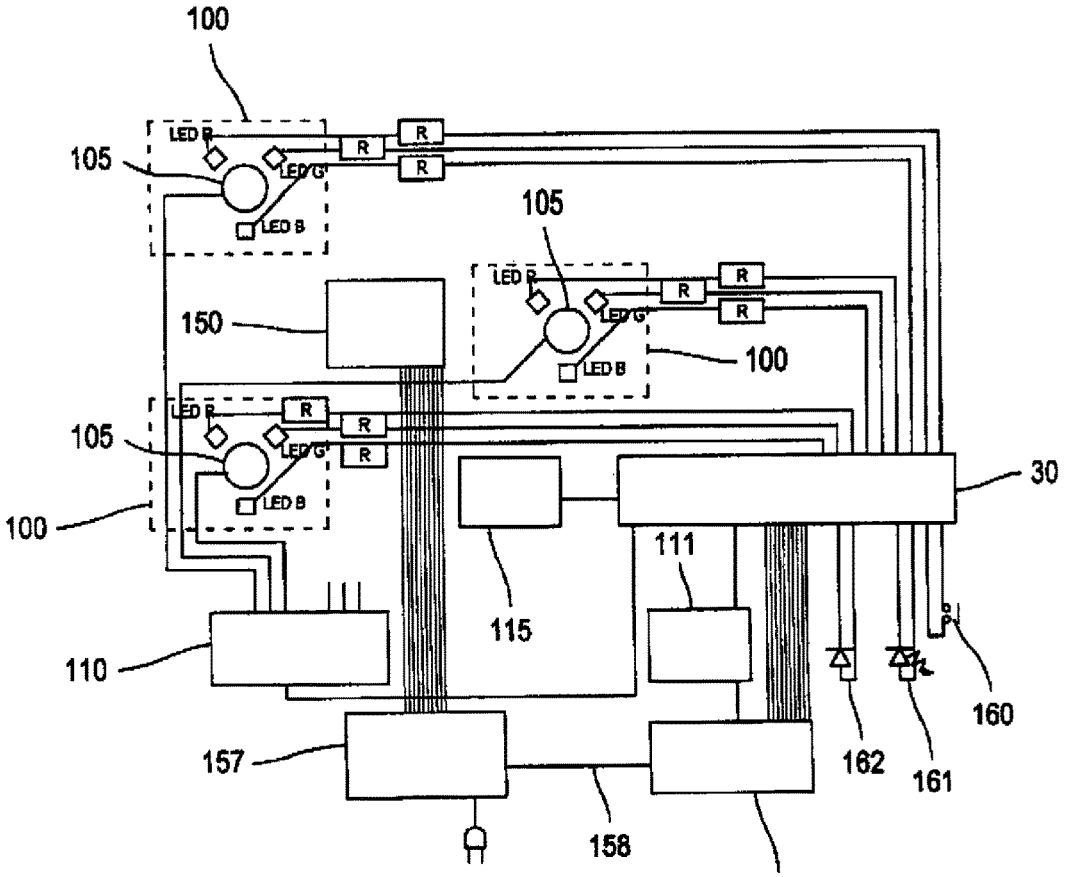
FIG. 7 is an electrical schematic diagram of an example of a device made in accordance with the invention.

FIG. 7 shows an embodiment example in greater detail.

In this example, the device has three color sensors 100.

The three color sensors are positioned in a triangle and spaced apart from one another by a distance of 4 cm, for example.

Each color sensor contains three LEDs, a first delivering red light (KP 2012SRD from the supplier Kingbright), a second delivering green light (KP 201MGC from the supplier Kingbright), and a third delivering blue light (KP 201PBC from the supplier Kingbright). As a result, the device contains a total of nine LEDs.

In addition to the three LEDs, each color sensor includes a photodetector 105, e.g. of reference C30807 from the supplier Perkin Elmer. In all, the device contains three photodetectors respectively referenced P1, P2, and P3.

Each color sensor may be positioned on the skin while being protected from ambient light.

The three LEDs are positioned so that they illuminate by delivering light towards the center and the photodetector receives light from skin as illuminated in this way.

The device causes the first LED R to be switched on, the light obtained by reflection from the skin to be captured, then the second LED R to be switched on, and so on until a third capture has been performed. The processor unit takes a first average of the three capture values. The device then performs the same operation for the three LEDs G and then for the three LEDs B. This sequence may be performed at a rate lying for example in the range 10 Hz to 1000 Hz, e.g. 100 Hz.

Optionally, the device contains at least one contact detector, e.g. that operates by measuring electrical resistance. The contact detector(s) is/are connected to the processor unit.

Signals from the photodetectors are converted into digital form by an analog-to-digital converter 110, e.g. a 6-input AD7794 from the supplier Analog Device, which converter incorporates a 6-input analog multiplexer, with use being made in this example of three of those inputs, and of an output.

The converter 110 receives the signals from the three photoreceivers 105 in sequential manner. Since each photoreceiver is activated three times, when each of the three color diodes with which it is associated is switched on, the converter receives a total of 9 signals that it converts into respective digital signals on 16 bits. The converter is connected to the processor unit, e.g. via a serial link 106 of the serial peripheral interface (SPI) type.

The processor unit 30 includes a programmable logic array, e.g. a Cyclone III EPC 3 from the supplier Altera, clocked by an oscillator 111 at a frequency of 24 megahertz (MHz), for example.

The processor unit is programmed to operate the diodes and the digital sensors at a rate of 100 Hz for example, as mentioned above.

The program that controls the action of the processor unit 30 is contained in a memory 115 of the EPROM type, e.g. an EPCS16 from the supplier Altera, and data is transferred from this memory to the unit 30 when it is switched on.

The device is provided with a button 160 for activating printing. This start/stop button is connected to the processor unit 30.

The processor unit 30 performs the following functions:

1) sequentially switching on the nine lighting LEDs. The sequence consists in switching on initially the three red diodes, one after another, then the three green diodes, one after another, and finally the three blue diodes, one after another;

2) controlling the converter 110 that is connected to the photodetectors 105;

3) managing digital capture from the converter 110 as received over the serial link 106;

4) performing calculation, which in the present example comprises taking three averages of three digital captures, i.e. the average of the three red captures, the average of the three green captures, and the average of the three blue captures, with each of the averages being encoded on 16 bits, for example;

5) performing 16-bit to 8-bit conversion on the three averages;

6) making a bitmap file made up of a plurality of portions, namely an "Infoheader" portion, a "color table" portion, an RGB color table, and an "image code" portion. The image code portion is organized as a succession of three average color values on 8 bits of the type: RGBRGBRGB . . . , each RGB group representing the printing of one pixel. The number of repeats corresponds to the number of pixels to be printed and is specified in the "Infoheader" portion. This number of pixels is programmable and the larger this number the greater the volume of ink that is deposited on the skin, and so the more the deposit will be visible. The "Infoheader" portion contains information concerning the lengths of the lines and the numbers of lines that are to be printed. Insofar as the device does not need such information, the processor unit may put standard numbers in this portion, which numbers are not used; and 7) indicating the state of the device and managing the user interface; the apparatus may inform the user that capture has been finished, that the averages have been taken, and that it is ready for printing. An LED 161, e.g. a green LED, may indicate that printing is ready to be triggered. A red LED 162 may indicate that an abnormal value has been detected and that printing should not be launched. The apparatus need not wait for instructions from the user and may launch printing without waiting.

In this example, the "print head" portion of a USB-interface jet printer is used, e.g. a printer sold under the trademark HP, Epson, or Lexmark. The printer shell is removed. The print head portion is extracted from its carriage while taking care to retain the connection between said print head and the printer electronics 157. It is also ensured that the ink cartridges are properly connected to the print head, given reference 150 in FIG. 7. Cosmetically acceptable inks are used.

The print head is placed relative to the color sensors so that the output from the head delivers ink towards the middle of the triangle formed by the three color sensors.

The print head is controlled, e.g. over a USB type wire connection 158, by a microcontroller 155, e.g. a CYZC68013 from the supplier Cypress, used in master mode. The microcontroller is clocked at 24 MHz for example using the same oscillator 111 as is used for the logic array 30.

The controller 155 is connected to the processor unit, e.g. via a parallel connection.

Operation

Color capture is triggered immediately the three sensors are pressed against the skin. In the present example, this means that the device does not wait for the user to actuate the print button in order to begin color capture.

The handpiece may be positioned on the skin in a zone that it is desired to make more uniform. It is possible to position the device and launch its action. Thus, in a few seconds, all of the operations are performed and the skin is covered in an ink that makes its tone uniform at a local level. This mode of use is particularly suitable when the correction zones are small, e.g. small color blemishes occupying a few millimeters, small scars, and small visible veins.

At the time of printing, it is also possible to move the handpiece a few millimeters. The advantage is to spread out the printing zone so as to treat larger-area zones.

The processor unit generates a bitmap file that the printer system knows how to interpret.

If intense printing is desired, the bitmap file is made up of a large number of dots for printing. The larger the number of dots printed by the print head, the greater the volume of ink that is delivered.

If medium printing is desired, then the bitmap file is made up of a smaller number of dots for printing. Where appropriate, the processor unit may diminish color component values, e.g. divide the three RGB components by a factor of 8 so as to make a bitmap file having a larger number of dots for printing.

If transparent printing is desired, then the color component values can be divided and a small number of dots printed.

The processor unit may generate other image files, in particular compressed files using the Jpeg and other standards. The processor unit may be provided with a conversion table that it keeps in memory, e.g. in the memory of the processor unit 30. This conversion table may have two portions, namely an "input" portion with RGB values as read by the apparatus, and an "output" portion with converted RGB values. This conversion table, which may be specific to each device, may be made by calibration when the apparatus is fabricated.

Regularly, the user may calibrate the device by acting as follows. A test is performed on a portion of the body, e.g. the front face of an arm. Three printed marks are made in this way. After printing, the apparatus is repositioned so that the color sensors are positioned over the three printed marks. The color sensors then measure the color as printed, with the processor unit taking the average and comparing this average with the averages obtained beforehand. The processor unit may then modify the conversion table.

It is possible to act on the print zone by enabling the print head to move towards or away from the skin, either directly or under motor control. Thus, by moving the print head away, a larger printed mark is obtained. The processor unit may be programmed to take this distance into account. If a larger distance is selected between the skin and the print head, then the processor unit may lengthen the printing sequence and increase the number of RGB sequences in the bitmap file to compensate for the fact that the size of the printed mark is greater.

A special function may serve to inactivate one or two sensors, since the user may desire to rely on only two sensors or on only one. This function may also be useful when the apparatus is used on a zone of the body that does not enable the three sensors to be made to engage the skin, e.g. a curved zone.

The invention is not limited to the examples described.

The device may be provided with buttons or other adjustment means enabling at least one and possibly all three color components, e.g. red, green, or blue, to be addressed, or else enabling one or the other or a combination of these components to be increased or decreased prior to printing. These buttons for increasing or decreasing color components may be connected to the processor unit that takes charge of making the corrections and that is capable of storing them in memory.

As mentioned above, the handpiece may be provided with a vibrator or a mechanical movement system that serves at the time of printing to cause the print head to move so as to spread out the printed zone without the user needing to move the handpiece over the skin. It is possible to use a vibrator of the kind that is used in cell phones.

The term "comprising a" should be understood as being synchronous with "comprising at least one".

The invention claimed is:

1. A method of applying make-up to a human keratinous material, the method comprising:

taking at least two measurements of a color of the keratinous material at different location; determining an optical characteristic forming an intermediate color and shades thereof that are intermediate between the at least two measurements of a color, where the intermediate color is an average or weighted average of the at least two measurements of color of the keratinous material; and applying a cosmetic deposit to the keratinous material, the cosmetic deposit being the intermediate color the cosmetic deposit being applied between at least two locations at which the color of the keratinous material has been measured, the color of the cosmetic deposit varying and shading off gradually between the at least two locations where the color was measured lying between the at least two measured colors of the keratinous material, the color of the cosmetic deposit varying on approaching edges of the cosmetic deposit so as to come close to the color of the keratinous material in a vicinity of the cosmetic deposit.

2. The method according to claim 1, wherein the cosmetic deposit includes one or more cosmetic inks.

3. The method according to claim 1, wherein the intermediate color is an average color.

4. The method according to claim 1, wherein the measurements and the application of the cosmetic deposit are performed by a single handpiece.

5. The method according to claim 1, wherein the measurements are performed at locations that are spaced apart by a distance having a range of 5 mm to 50 mm.

6. The method according to claim 1, wherein the color of the cosmetic deposit includes at least two different cosmetic inks.

7. A device for making up a human keratinous material, the device comprising:

an acquisition system including at least two color sensors which are spaced apart and configured to obtain at least two measurements of a color of the keratinous material at different locations, a processor programmed to determine an optical characteristic forming an intermediate color and shades thereof that are intermediate between the at least two measurements of a color where the intermediate color is an average or weighted average of the at least two measurements of color of the keratinous material; and a printer system comprising a plurality of cosmetic inks for creating the optical characteristic;

wherein the printer system is configured to apply the cosmetic inks having the intermediate color and shades thereof as a cosmetic deposit to the keratinous material in an area between the different locations, wherein the intermediate color is applied at a specific location between the two different locations and the shades thereof vary gradually between the intermediate color and the colors at the two different locations the intermediate color varies on approaching edges of the cosmetic deposit so as to come close to the color of the keratinous material in a vicinity of the deposit, and the device houses a handpiece that includes the acquisition system and the printer system.

8. The device according claim 7, further comprising:

an interface enabling a user to modify the color of the cosmetic deposit prior to printing.

9. A device for making up a human keratinous material, the device comprising:

an acquisition system enabling at least two measurements of a color of the keratinous material to be performed at different spaced apart locations via color sensors, a processor programmed to determine an optical characteristic forming an intermediate color and shades thereof that are intermediate between the at least two measurements of a color where the intermediate color is an average or weighted average of the at least two measurements of color of the keratinous material; and a printer system comprising a plurality of cosmetic inks for creating the optical characteristic;

wherein the printer system is configured to apply the cosmetic inks having the intermediate color and shades thereof as a cosmetic deposit to the keratinous material in an area between the different locations, wherein the intermediate color is applied at a specific location between the two different locations and the shades thereof vary gradually between the intermediate color and the colors at the two different locations the intermediate color varies on approaching edges of the deposit so as to come closer of the keratinous material in a vicinity of the deposit, and the printer system includes a vibrator configured to create a fuzziness on application.

* * * * *